US008152555B2

(12) United States Patent
Wu

(10) Patent No.: US 8,152,555 B2
(45) Date of Patent: Apr. 10, 2012

(54) ELECTRICAL CONNECTOR ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/231,990

(22) Filed: Sep. 14, 2011

(65) Prior Publication Data

US 2012/0064750 A1 Mar. 15, 2012

(51) Int. Cl.
*H01R 13/62* (2006.01)

(52) U.S. Cl. ..... 439/352

(58) Field of Classification Search ..... 439/352, 439/357, 358

See application file for complete search history.

(56) References Cited

U.S. PATENT DOCUMENTS 7,281,937 B2 10/2007 Reed et al.
7,581,978 B1 9/2009 Tyco
7,666,023 B2 * 2/2010 Wu ..... 439/352
7,828,579 B2 * 11/2010 Huang ..... 439/352
2011/0183535 A1 * 7/2011 Wu ..... 439/153
2011/0281455 A1 * 11/2011 Wu ..... 439/345

* cited by examiner

*Primary Examiner* — Tho D Ta

(74) *Attorney, Agent, or Firm* — Wei Te Chung; Andrew C. Cheng; Ming Chieh Chang

(57) ABSTRACT

An electrical connector assembly (100), comprises: a housing (1) having a receiving room (11) therein communicated with an exterior along a longitudinal direction and defining a receiving cavity (14) formed on a top surface thereof. A pair of supporting posts (143) are formed in the receiving cavity. Two paralleled printed circuit boards (2) are received into the receiving room and positioned in the housing. A latching member (6) is located in the receiving cavity and engaged with the housing. A pulling member (7) is supported by the top surface of the housing and having a front portion extending into the receiving cavity and interconnected with the latching member. The pulling member defines a curving portion (722) supported by the pair of supporting posts.

9 Claims, 11 Drawing Sheets

ELECTRICAL CONNECTOR ASSEMBLY

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

As discussed above, an improved electrical connector overcoming the shortages of existing technology is needed.

SUMMARY OF THE INVENTION

Accordingly, an object of the present invention is to provide an electrical connector assembly with high-density configuration and high data transmitting rate, and easily mating to and discrete from a complementary connector.

In order to achieve the above-mentioned objects, an electrical connector assembly, comprises: a housing having a receiving room therein communicated with an exterior along a longitudinal direction and defining a receiving cavity formed on a top surface thereof, a pair of supporting posts formed in the receiving cavity; two paralleled printed circuit boards received into the receiving room and positioned in the housing; a latching member located in the receiving cavity and engaged with the housing; and a pulling member supported by the top surface of the housing and having a front portion extending into the receiving cavity and interconnected with the latching member, the pulling member defining a curving portion supported by the pair of supporting posts.

Other objects, features and advantages of the invention will be apparent from the following detailed description taken in connection with the accompanying drawings.

DETAILED DESCRIPTION OF PREFERRED EMBODIMENTS

Figure 1:
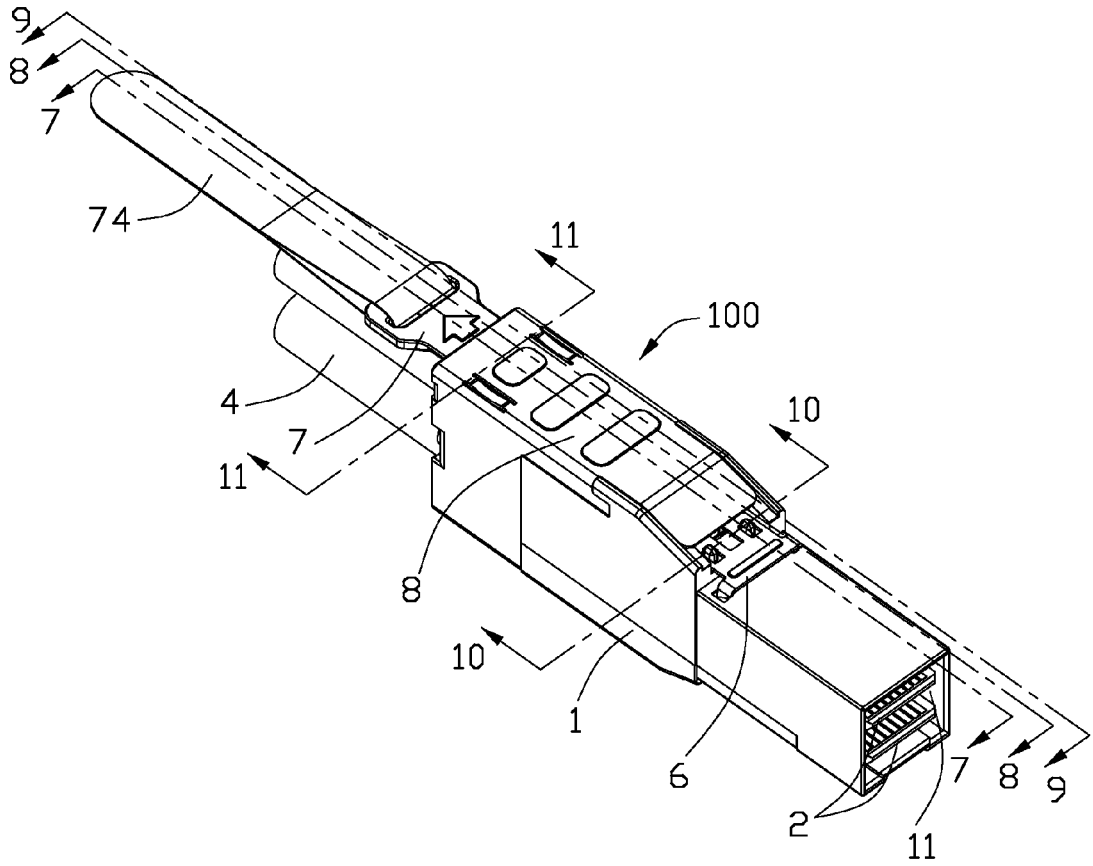
FIG. 1 is a perspective view of an electrical connector assembly in accordance with the present invention.
Figure 2:
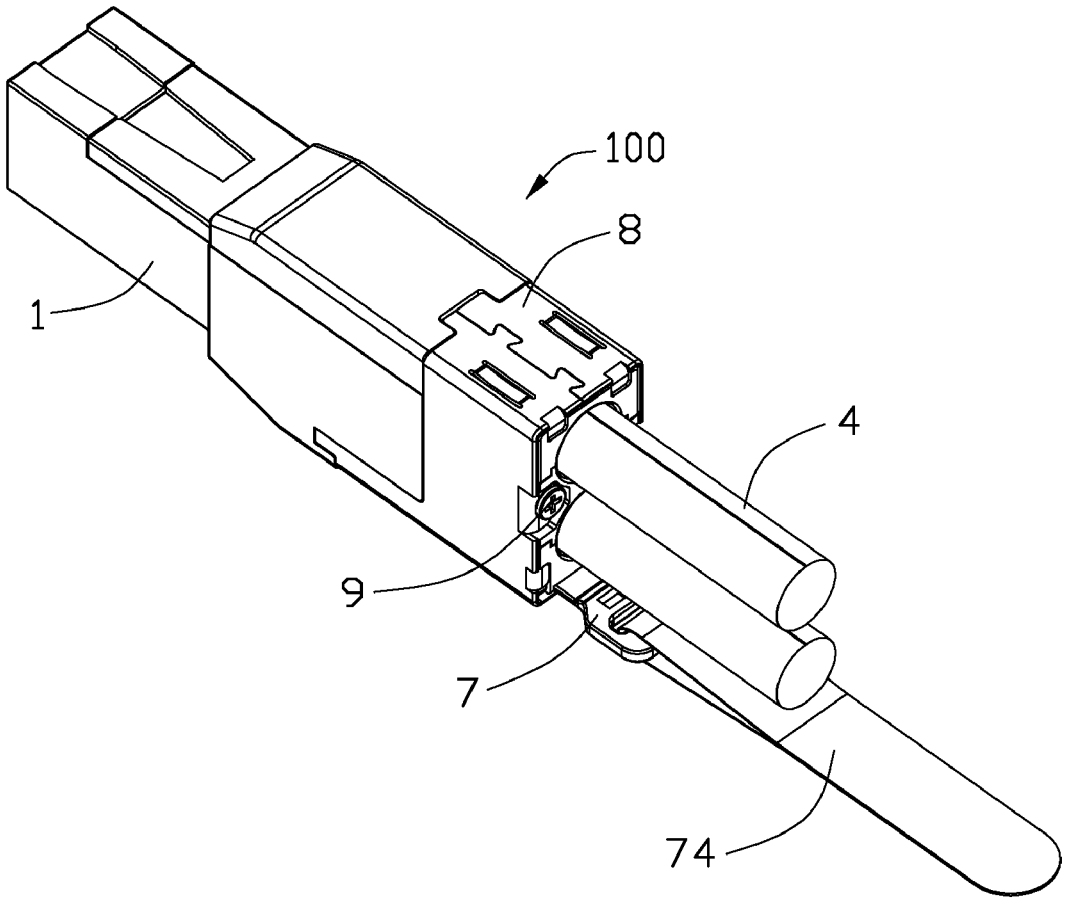
FIG. 2 is another perspective view of the electrical connector assembly of FIG. 1.
Figure 3:
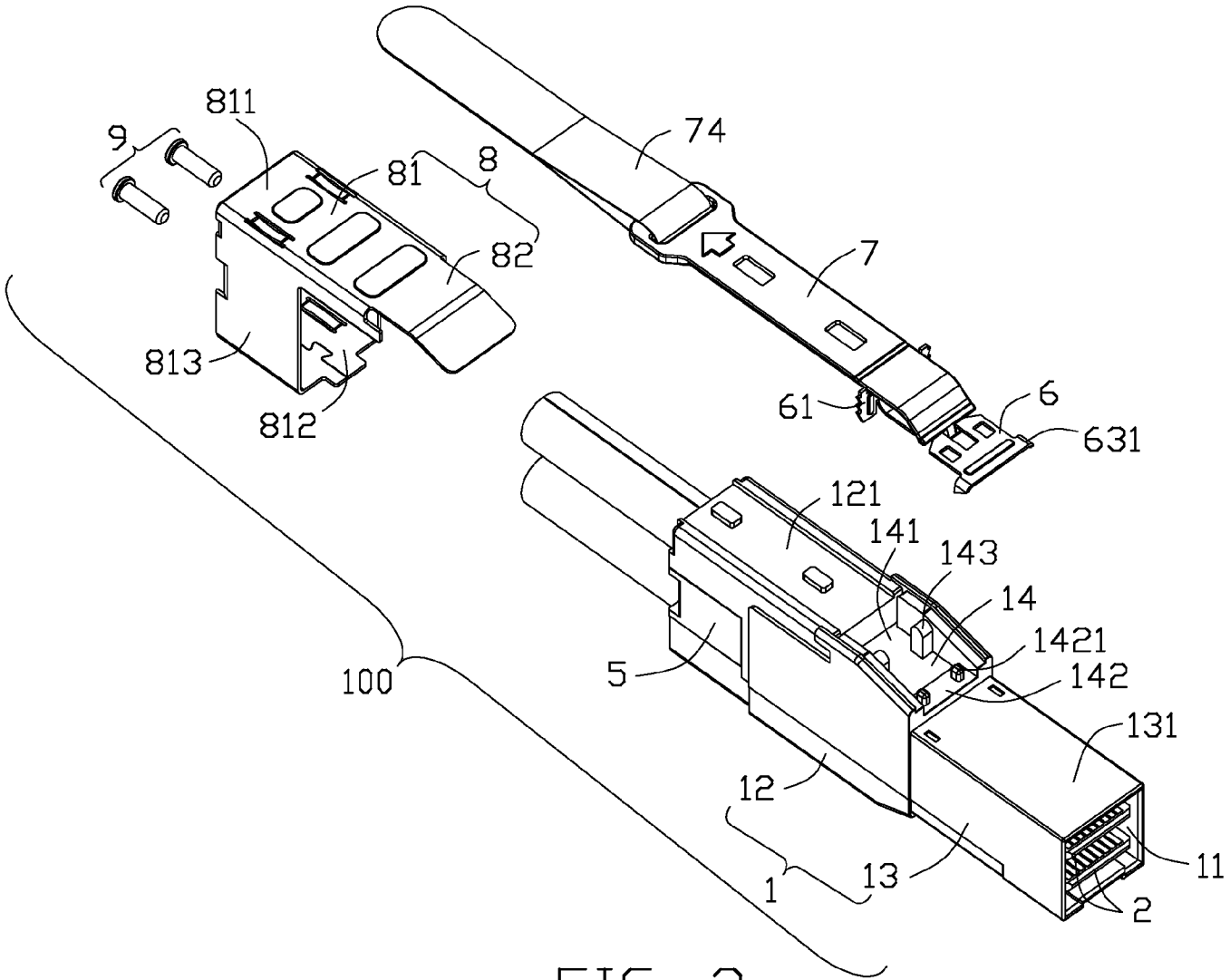
FIG. 3 is a partial exploded, perspective view of the electrical connector assembly of FIG. 1.
Figure 4:
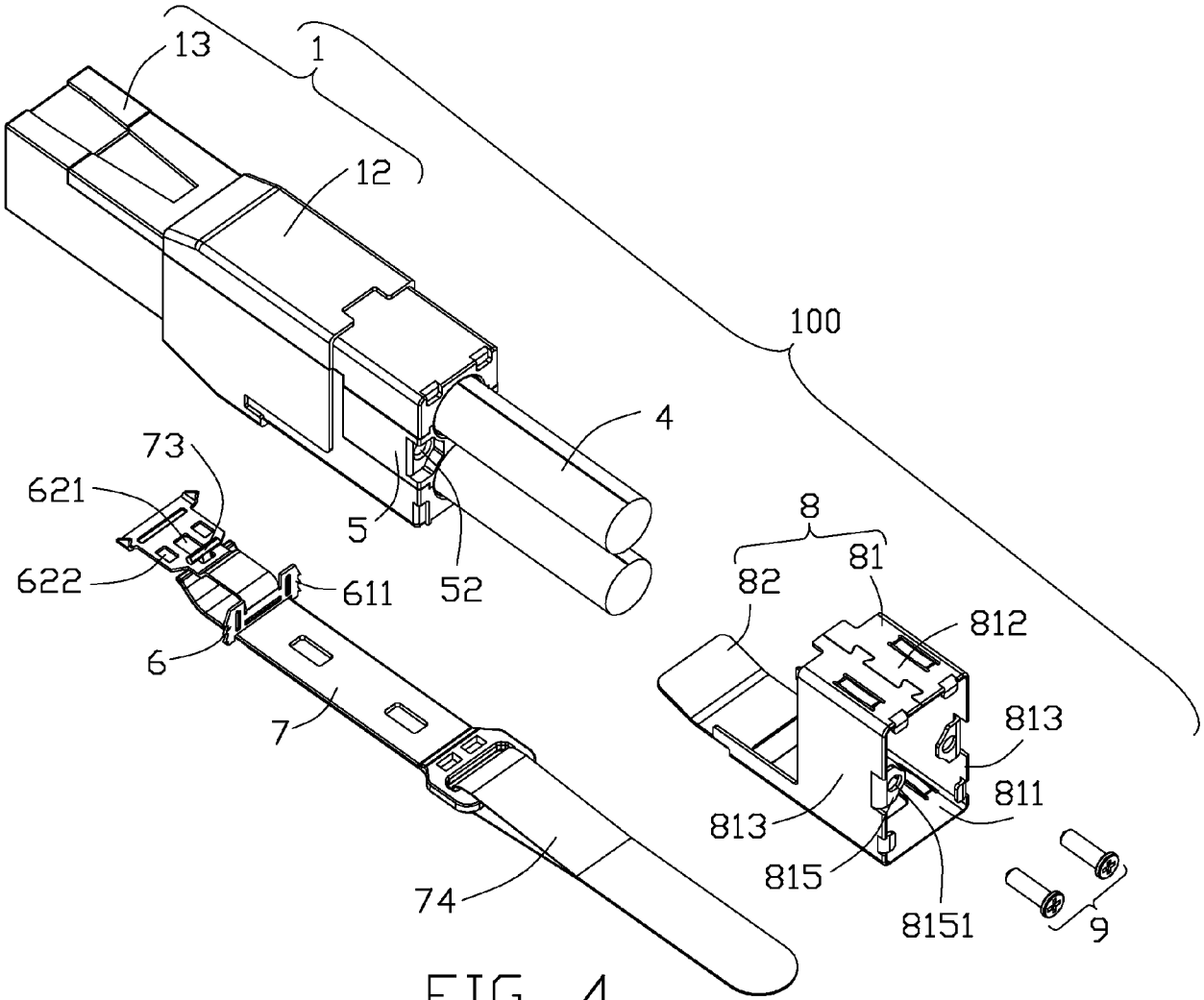
FIG. 4 is a partial exploded, perspective view of the electrical connector assembly of FIG. 2.

Reference will now be made to the drawing figures to describe the present invention in detail.

FIGS. 1 to 4 illustrate perspective views of an electrical connector assembly 100 made in accordance with the present invention. And in conjunction with FIG. 9, the electrical connector assembly 100 comprises a housing 1 having a receiving room 11 therein, two paralleled printed circuit boards (PCBs) 2 disposed in the receiving room 11, a spacer 3 disposed between the two printed circuits boards 2 and positioned with the housing 1, two cables 4 respectively electrically connected with a printed circuit board 2 and a strain relief 5 disposed in the housing 1 and spaced apart with the two cables 4. The electrical connector assembly 100 further comprises a latch mechanism assembled to a top surface of the housing 1 and a metallic holder 8 surrounding a portion of the housing 1 and the latch mechanism. The latch mechanism comprises a latching member 6 and a pulling member 7 interconnected with each other.

Referring to FIGS. 3 to 6, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The housing 1 defines a receiving room 11 extending rearward from a front surface to a rear surface thereof. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface (not figured) toward to the second surface 131. The body portion 12 defines a receiving cavity 14 extending downwardly from the inclined surface for a distance. The receiving cavity 14 has a bottom surface 141 located on a same level with the second face 131. And, the bottom surface 141 is defined as a third surface. A prominence 142 is formed in a front edge of the receiving cavity 14 to separate the third surface 141 and the second surface 131 along a front to rear direction. And, the prominence 142 further defines a pair of protrusions 1421 formed on a top surface thereof. In addition, a pair of supporting posts 143 are formed on two inner side surfaces of the receiving cavity 14 for supporting a front curving portion 72 of the pulling member 7.

Figure 5:
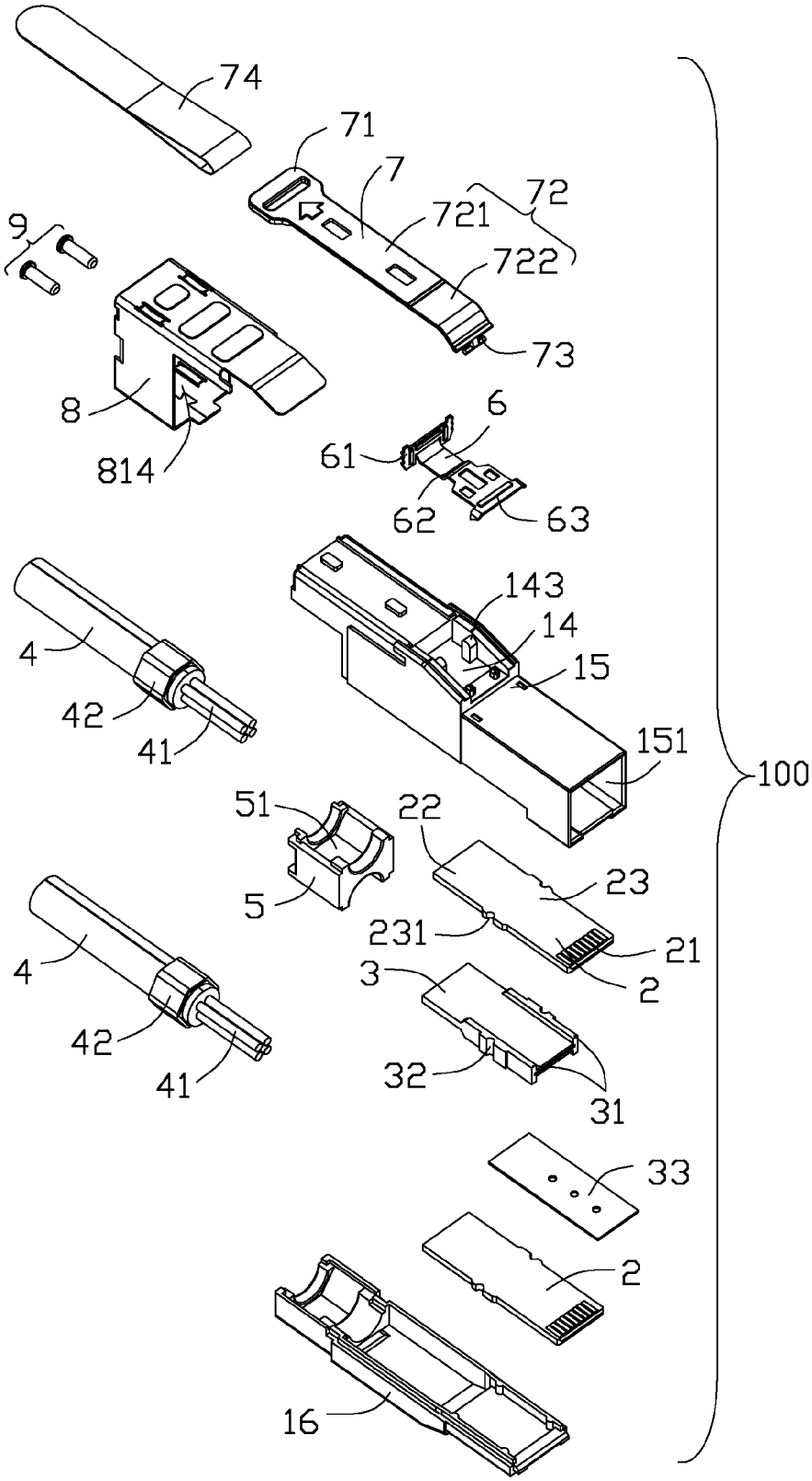
FIG. 5 is an exploded, perspective view of the electrical connector assembly of FIG. 1.
Figure 6:
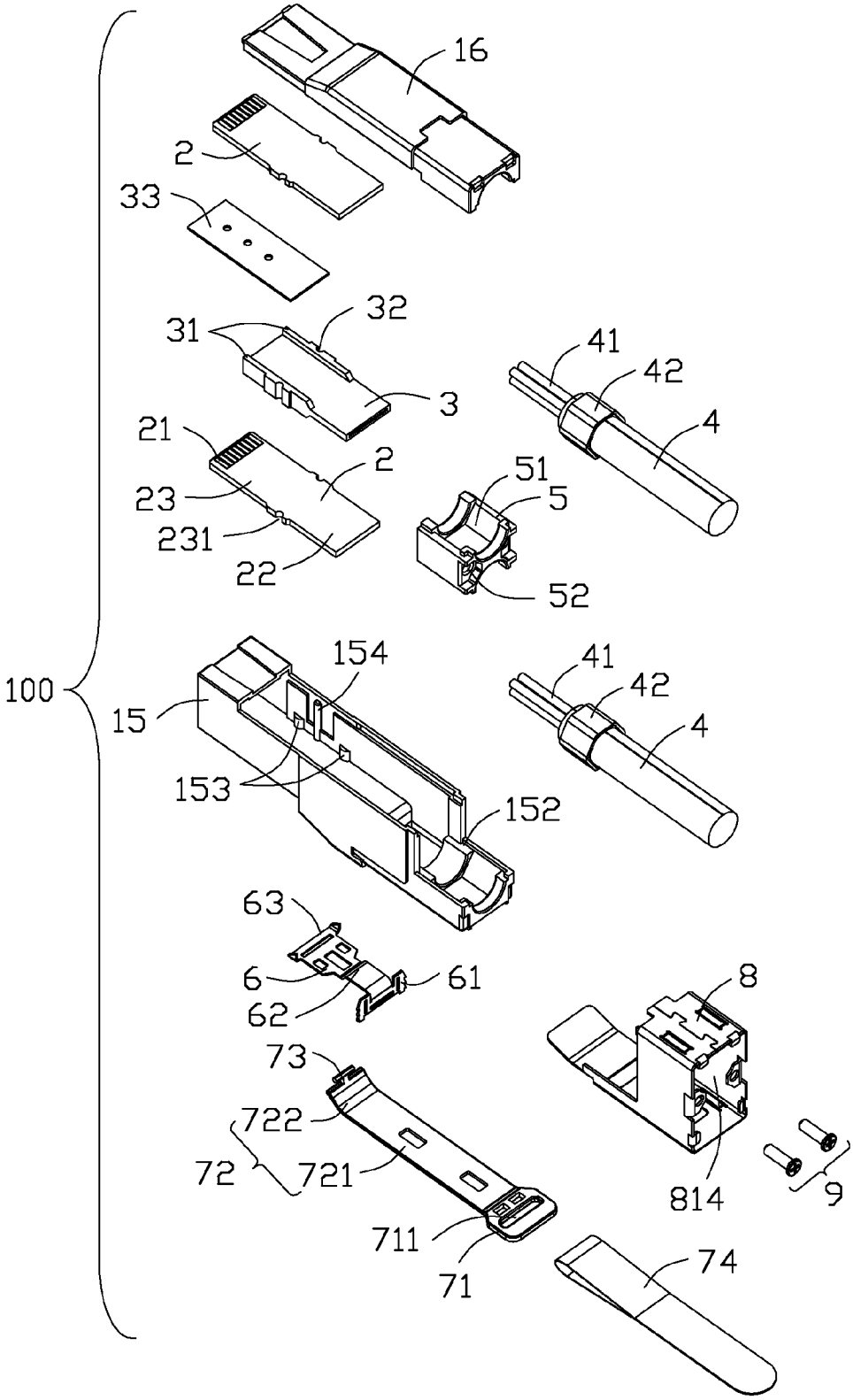
FIG. 6 is another exploded, perspective view of the electrical connector assembly of FIG. 5.
Figure 7:
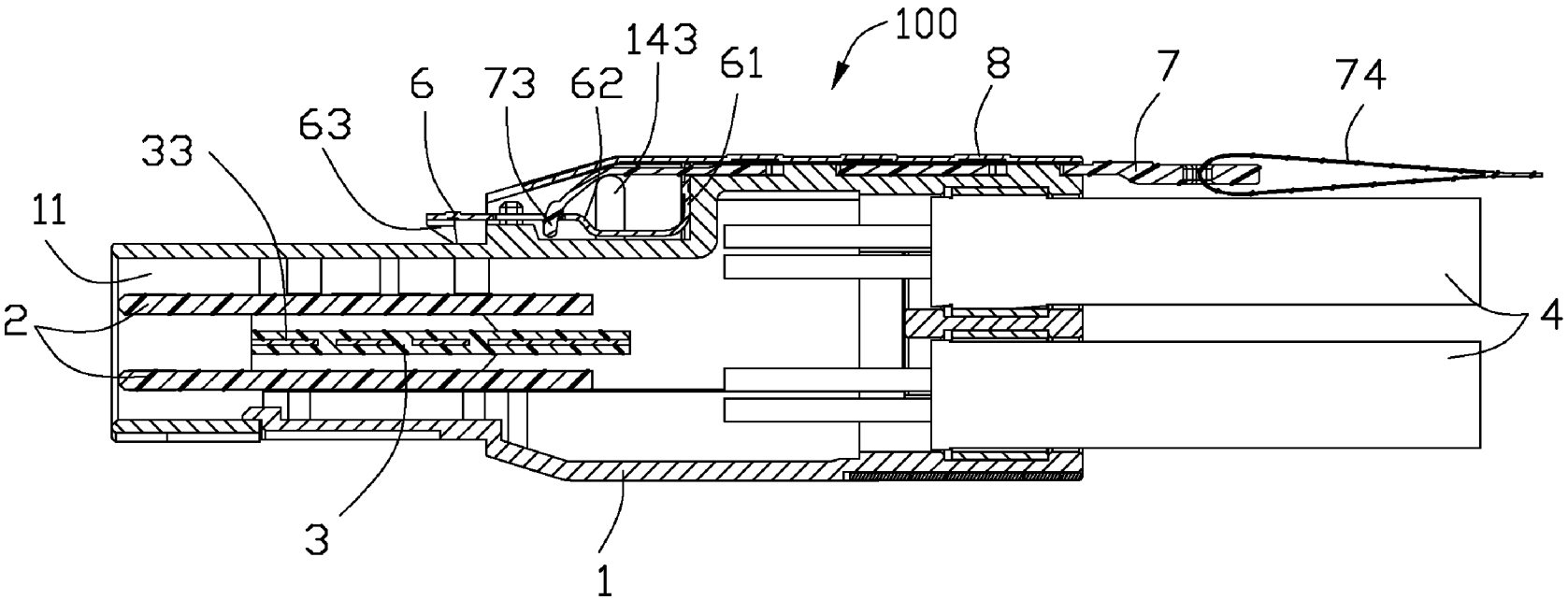
FIG. 7 is a cross section view of the electrical connector assembly of FIG. 1 taken along line 7-7.

Referring to FIGS. 5 to 6, the housing 1 comprises a box-shape first shield part 15 and a second shield part 16 assembled with each other. The first shield part 15 defines a rectangular frame 151 formed at a front end thereof and defined as a mating port of the housing 1. The first shield part 15 further defines an opening 152 formed at a bottom end thereof. The opening 152 of the first shield part 15 will be shielded when the second shield part 16 is assembled to the first shield part 15. The first shield part 15 defines two first positioning posts 153 formed on an inner side surface thereof and another two first positioning posts 153 formed on another inner side surface thereof. Each two first positioning posts 153 are spaced apart with each other along a front-to-rear direction. Each first positioning post 153 has a semi-circular cross section. The first positioning posts 153 are used for supporting the printed circuit board 2 along an up-to-down direction. In addition, two second positioning posts 154 are respectively formed on two inner side surface of the first shield part 15. Each second positioning post 154 is disposed between the two first positioning posts 154 along a front-to-rear direction for limiting a movement of the printed circuit board 2 along a front to rear direction. Each second positioning post 154 also has a semi-circular cross section. And, the second positioning post 154 is longer than the first positioning post 153 along an up-to down-direction.

Referring to FIG. 6, two printed circuit boards 2 are received into the receiving room 11 of the housing 1. Each of the printed circuit board 2 defines a front mating section 21, a rear terminating section 22 and a connecting section 23 connecting the mating section 21 to the rear terminating section 22. And, the connecting section 23 defines two slots 231 respectively cooperating with two second positioning posts 154 of the first shield part 15.

Referring to FIGS. 5 to 6, a spacer 3 is formed of insulative material and defines a top surface and a bottom surface. The spacer 3 defines a pair of ribs 31 respectively formed at two sides of the top surface and another pair of ribs 31 respectively formed at two sides of the bottom surface for supporting two printed circuit boards 2. The spacer 3 further defines a pair of grooves 32 respectively formed on two sides thereof and extending along a vertical direction for cooperating with the two second positioning posts 154. The spacer 3 further defines a grounding plate 35 integrative formed therein.

Referring to FIGS. 5 to 6, each of the cable 4 has a plurality of conductors 41 electrically connected to the terminating section 22 of the printed circuit board 2. And, a ring 42 is surrounded to an outer surface of the cable 4.

Referring to FIGS. 3 to 6 and in conjunction with FIGS. 12 and 14, a strain relief 5 is made of metallic material and disposed into the housing 1. The strain relief 5 has two recesses 51 respectively formed on a top and bottom surfaces thereof for receiving a portion of the two rings 42. The strain relief 5 defines a pair of receiving holes 52 formed on a rear surface thereof. The pair of receiving holes 52 are located at two sides of the rear surface of the strain relief 5.

Referring to FIGS. 3 to 7, the latching member 6 is stamped and formed from a metallic plate and comprises a vertical retaining portion 61, a connecting portion 62 extending forwardly from a bottom side of the retaining portion 61 and a latching portion 63 extending forwardly from the connecting portion 62. A front portion of the latch 6 is defined as a latching portion 63. The retaining portion 61 defines a plurality of sharp projections 611 formed at two sides thereof. The connecting portion 62 defines a rectangular hole 621 and a pair of quadrate holes 622 disposed at two sides of the rectangular hole 621. The latching portion 63 defines a pair of barbs 631 formed at two sides thereof. The pair of quadrate holes 622 are cooperated with a pair of protrusions 1421 of the housing 1.

Figure 11:
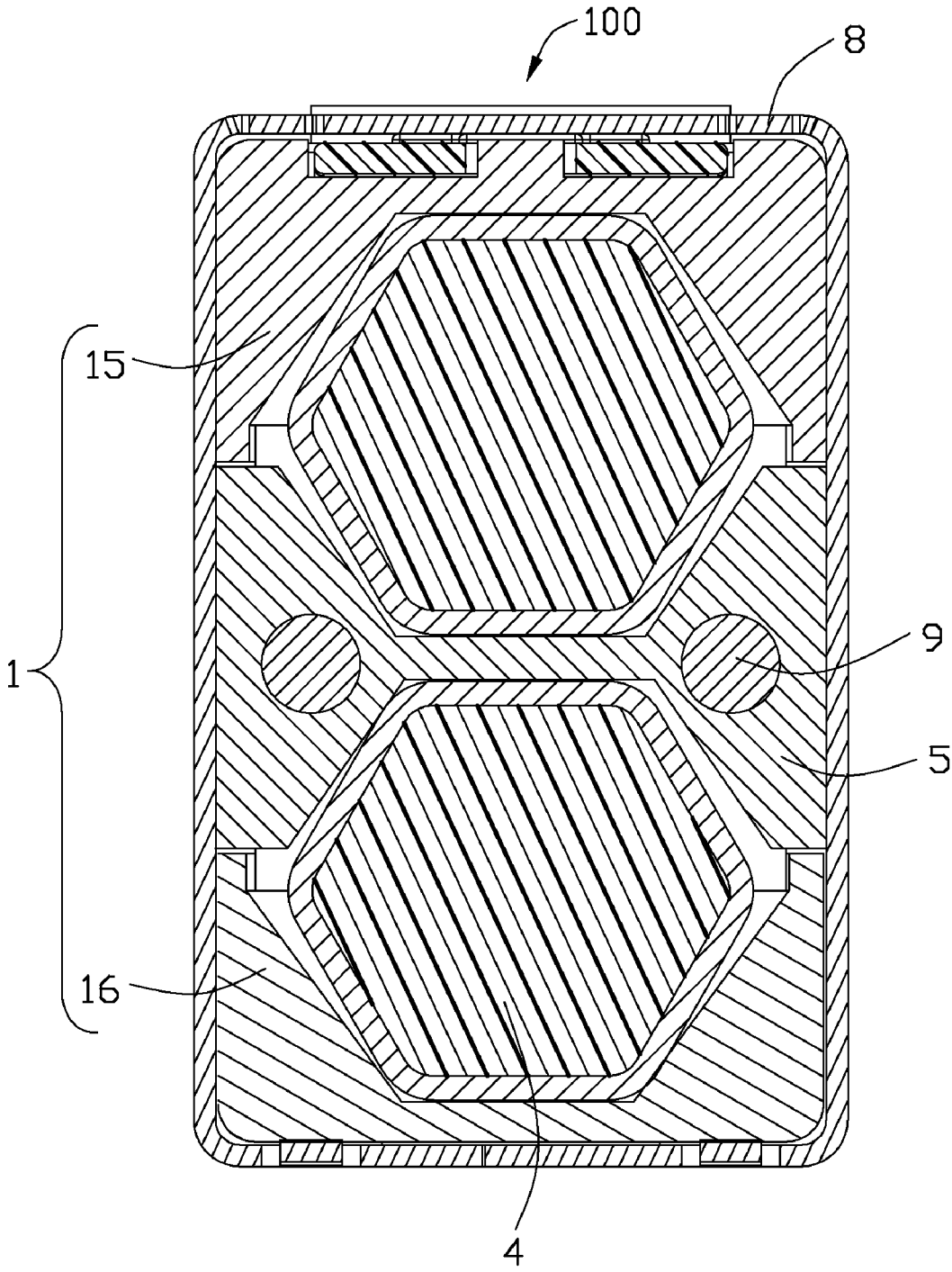
FIG. 11 is a cross section view of the electrical connector assembly of FIG. 1 taken along line 11-11.

Referring to FIGS. 5 to 6 and in conjunction with FIG. 11, the pulling member 7 is made of insulative material and structured in a flat shape. The pulling member 7 defines a T-shape actuating section 73, a rear operating section 71 and a connecting section 72 connecting the actuating section 73 and the rear operating section 71. And the connecting section 72 defines a horizontal section 721 and a curving section 722 extending forwardly and downwardly from the horizontal section 721. The operating section 71 of the pulling member 7 defines a slit 711. A tape 74 is passed through the slit 711 and connected to the pulling member 7.

Referring to FIGS. 3 to 6, the metallic holder 8 defines a main portion 81 binding the first shield part 15 and the second shield part 16 and a shielding portion 82 extending forwardly from the main portion 81. The main portion 81 has a top wall 811, a bottom wall 812 and a pair of side walls 813 connected with the top wall 811 and the bottom wall 812. A receiving space 814 is formed by the top wall 811, the bottom wall 812 and the pair of side walls 813. The shielding portion 82 extends forwardly and downwardly from the top wall 811. Each side wall 813 defines a tab 815 extending into the receiving space 814 from a rear edge thereof. And, the tab 815 is perpendicular to the side wall 813 and defines a through hole 8151 corresponding to a receiving hole 52 of the strain relief 5. The top wall 811 and the bottom wall 812 respectively has two spring tabs (not figured) to hold the first shield part 15 and second shield part 16 along a vertical direction.

Figure 8:
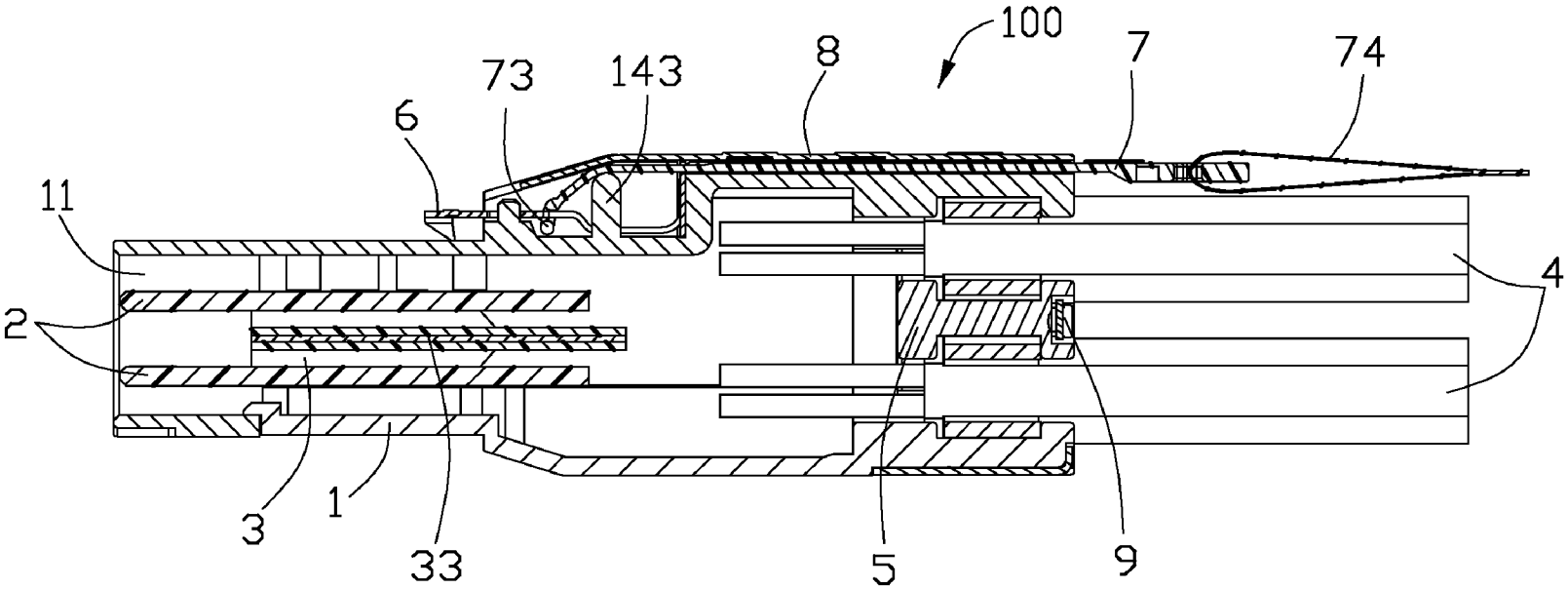
FIG. 8 is a cross section view of the electrical connector assembly of FIG. 1 taken along line 8-8.
Figure 9:
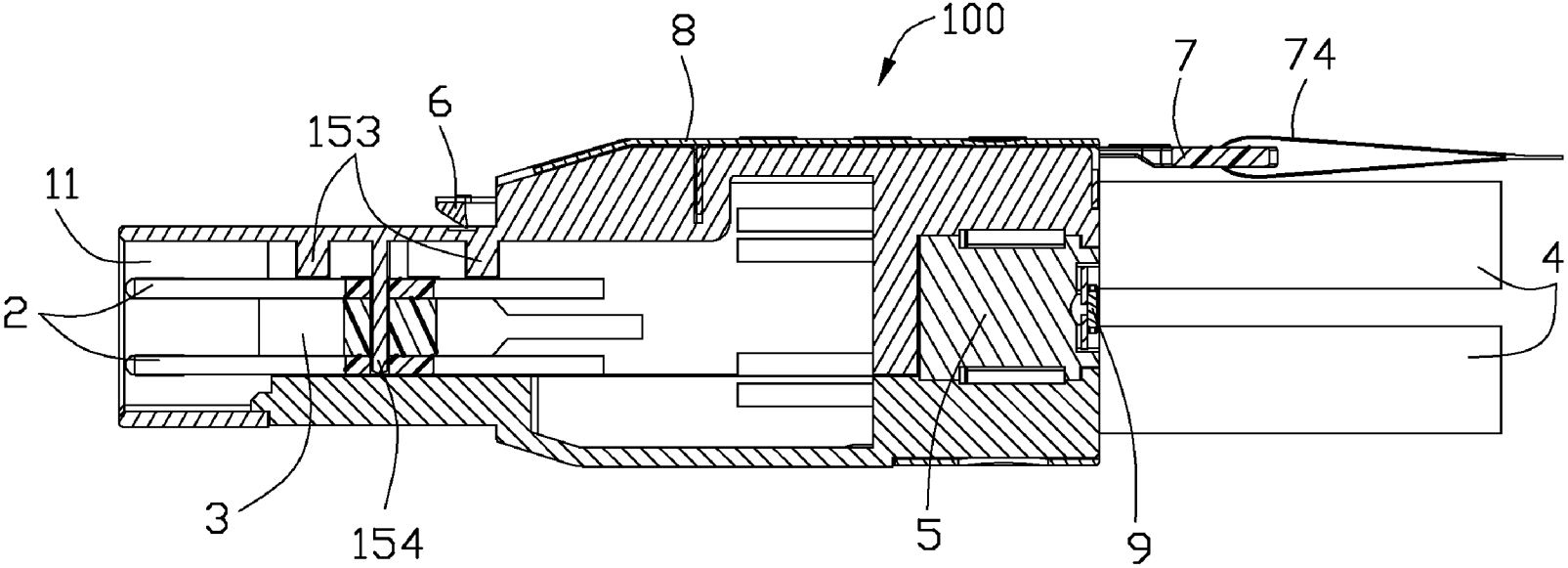
FIG. 9 is a cross section view of the electrical connector assembly of FIG. 1 taken along line 9-9.
Figure 10:
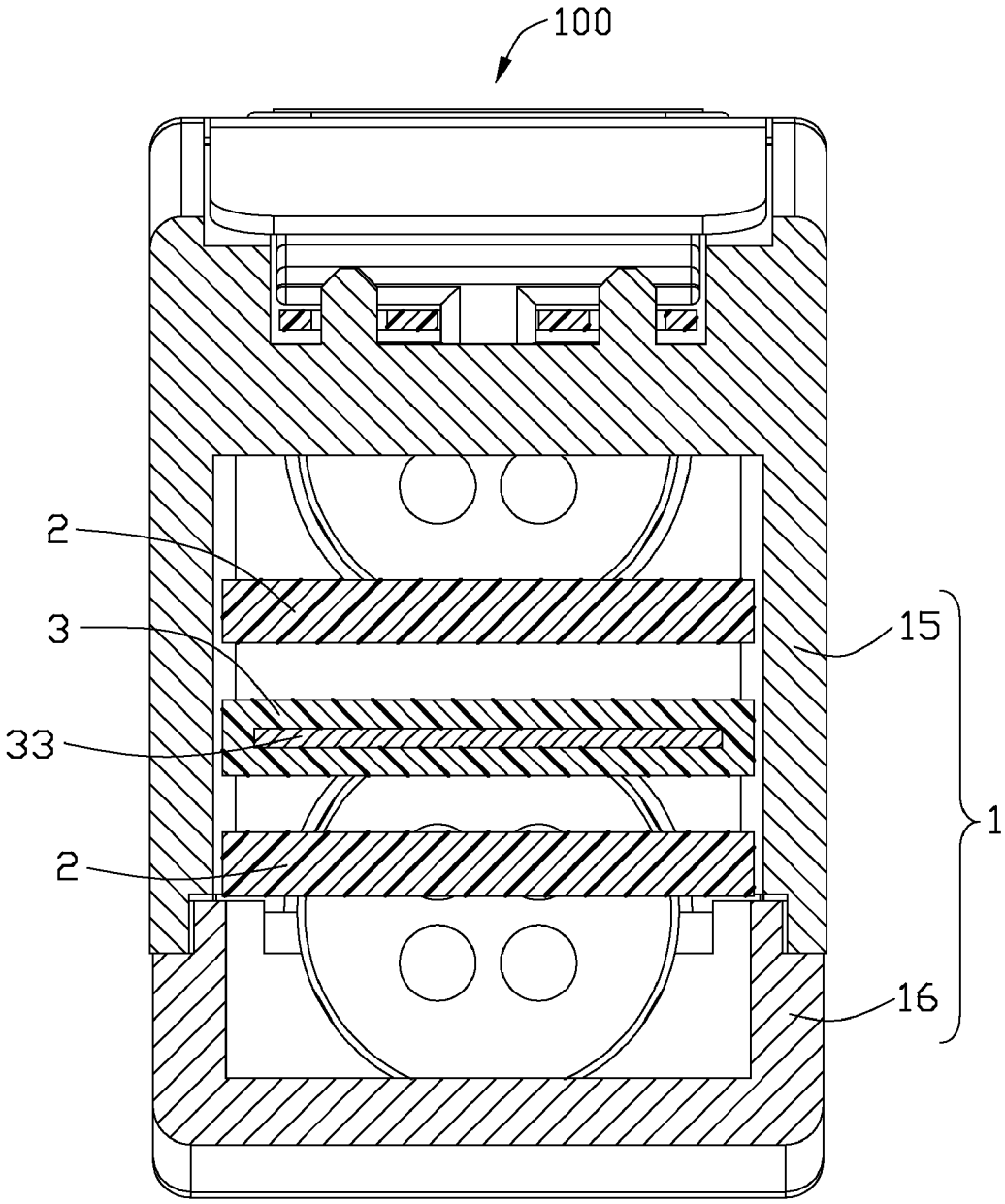
FIG. 10 is a cross section view of the electrical connector assembly of FIG. 1 taken along line 10-10.

Referring to FIGS. 3 to 6 and in conjunction with FIGS. 8 to 9, two engaging devices 9 are assembled to the strain relief 5. In this embodiment, the engaging device 9 is a screw. Two screws 9 are passed through the two through holes 8151 and received into the receiving holes 53 to interlock the metallic holder 8 and the strain relief 5. As the strain relief 5 is disposed in the housing 1, so the metallic holder 8 is indirectly positioned with the housing 1 through the screws 9.

Referring to FIGS. 1 to 11, the assembling process of the electrical connector assembly 100 made in according to the present invention starts from soldering the conductors 41 of each cable 4 to the terminating section 22 of the printed circuit board 2. Thus, two combinations of the cable 4 and the printed circuit board 2 are accomplished.

Then, turning over the first shield part 15 to make the opening 152 facing upward and assembling a combination of the cable 4 and the printed circuit board 2 into the first shield part 15 through the opening 152. The printed circuit board 2 is supported by the first positioning posts 153 along a vertical direction. The printed circuit board 2 is positioned with the first shield part 15 along a front-to-rear direction due to two slots 231 of the printed circuit board 2 cooperated with the pair of second positioning posts 154 of the shield part 15. And, a front end of the cable 4 is supported by a rear end of the shield part 15.

Then, assembling the strain relief 5 to a rear end of the first shield part 15. And, the ring 42 of the cable has a half portion received into a corresponding structure of the first shield part 15. The ring 42 has another half portion received into a recess 51 of the strain relief 5.

Then, assembling the spacer 3 into the first shield part 15. The spacer 3 is positioned with the first shield part 15 and located on the first PCB 21. The pair of second positioning posts 154 of the first shield part 15 pass through the corresponding two grooves 32 of the spacer 3 along an up-to-down direction to limit a movement of the spacer 3 along a front to rear direction.

Then, assembling another combination of the printed circuit board 2 and the cable 4 together into the first shield part 15 and located on the spacer 3. The printed circuit board 2 is positioned with the first shield part 15 along a front-to-rear direction due to two slots 231 of the printed circuit board 2 cooperated with the pair of second positioning posts 154 of the first shield part 15. And, a front end of the cable 4 is supported by the strain relief 5. The ring 42 of the cable 4 has a half portion located in another recess 51 of the strain relief 5.

Then, assembling the second shield part 16 to the first shield part 15. Thus, the opening 152 of the first shield part 15 is shielded by second shield part 16 along an up-to-down direction. And, the two printed circuit boards 2 are received into the receiving room 11 of the housing 1 and positioned in the housing 1.

Then, assembling the latching member 6 to the pulling member 7 together through following steps. Firstly, the latching member 6 is disposed in front of pulling member 7 and arranged perpendicular to the pulling member 7. Secondly, the actuating section 73 of the pulling member 7 is passed through the rectangular hole 621 of the latching member 6 and located below the latching member 6. Thirdly, the latching member 6 is rotated 90 degree to make the latching member 6 and the pulling member 7 arranged in line. Thus, the latching member 6 is interconnected with the pulling member 7. And, the latching 6 is not easily discrete from the pulling member 7 due to the width of the actuating section 73 is wider than the rectangular hole 621.

Then, assembling the latching member 6 and the pulling member 7 together to an exterior surface of housing 1. The connecting section 72 of the pulling member 7 is located on the first surface 121 of the body portion 12 of the housing 1. The curving section 722 of the pulling member 7 is supported by the pair of supporting posts 143 located in the receiving cavity 14. Thus, the pair of supporting posts 143 are attached to a bottom surface of the curving section 722 of the pulling member 7. The operating section 71 of the pulling member 7 extends rearwardly and is beyond the rear surface of the housing 1. In addition, the latching member 6 is received into the receiving cavity 14. Thus, the actuating section 73 of the pulling member 7 is disposed between the latching member 6 and the third surface 141 of the receiving cavity 14. The retaining portion 61 of the latching member 6 is engaged with the housing 1. The connecting portion 62 of the latching member 6 is located above the third surface 141. The latching portion 63 extends forwardly and is located above the second surface 131 of the mating portion 13 of the housing 1. The latching portion 63 is cantilevered from the retaining portion 61. A tape 74 is passed through the slit 711 and connected to the pulling member 7. When a rearward pulling force is exerted on a rear end of the pulling member 7 or the tape 74, the latching portion 63 of the latching member 6 will be raised up. When the rearward pulling force is released, the latching portion 63 of the latching member 6 will resume to an original state.

Finally, assembling a metallic holder 8 to the housing 1. The main portion 81 of the metallic holder 8 binds the first part 15, the second shield part 16 and a portion of the pulling member 7 together. The pulling member 7 can be moved along a front to rear direction relative to the housing 1 and limited by the metallic holder 8 along a vertical direction. The strain relief 5 is also limited in the housing 1 by the metallic holder 8 through the pair of screws 9. The rear end of the latching member 6 and the front end of the pulling member 7 is shielded by the shielding portion 82 of the metallic holder 8.

After the above assembling steps, the entire process of assembling of the electrical connector assembly 100 is finished. The electrical connector assembly 1 has a new mating surface to meet higher and higher data transmitting rate. In addition, the electrical connector assembly 1 has a narrow profile and high-density configuration. Thus, the complementary connector (not shown) for mating with the electrical connector assembly 100 will also occupy little space to meet a miniaturization of an internal room of the communication device. On another aspect, a reliable latch mechanism is provided to an exterior surface of the housing. And, an easily and conveniently operating manner between the latching member 6 and the pulling member 7 is achieved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing having a receiving room therein communicated with an exterior along a longitudinal direction and defining a receiving cavity formed on a top surface thereof, a pair of supporting posts formed in the receiving cavity;

two paralleled printed circuit boards received into the receiving room and positioned in the housing;

a latching member located in the receiving cavity and engaged with the housing; and a pulling member supported by the top surface of the housing and having a front portion extending into the receiving cavity and interconnected with the latching member, the pulling member defining a curving portion supported by the pair of supporting posts;

wherein the electrical connector assembly further comprises two cables extending into the receiving room and respectively electrically connected with two printed circuit boards;

wherein the electrical connector assembly further comprises a strain relief disposed in a rear end of the receiving space and separating the two cables along an up-to-down direction;

wherein the housing defines a mating port formed on front end of the first shield part, two mating portions of the two printed circuit boards are disposed in the mating port;

wherein the electrical connector assembly further comprises a metallic holder binding the first shield part and the second shield part together.

2. The electrical connector assembly as recited in claim 1, wherein the electrical connector assembly further comprises a spacer disposed between the two printed circuit boards, and the spacer further defines a grounding plate integrative formed therein.

3. The electrical connector assembly as recited in claim 1, wherein the housing comprises a first shield part and a second shied part assembled with each other along a vertical direction.

4. The electrical connector assembly as recited in claim 1, wherein the latching member is operated in a lever manner when the pulling member is moveable in a horizontal direction.

5. The electrical connector assembly as recited in claim 1, wherein the metallic holder defines a plurality of spring tabs to hold the first and second shield parts.

6. An electrical connector assembly, comprising:

a metallic housing having a body portion and a mating portion extending forwardly form the body portion, the body portion defining a receiving cavity formed on a top surface of the body portion;

a plurality of conductive contacts disposed in the housing;

a latching member received into the receiving cavity and engaged with the housing, a pair of supporting posts located in the receiving cavity; and a pulling member located on the top surface of the body portion of the housing and moveable relative to the housing along a front-to-rear direction, the pulling member having a front actuating section extending into the receiving cavity and interconnected with the latching member and a curving section supported by the pair of supporting posts, whereby the pulling member is pulled rearward, the actuating section moves upward and causes the front end of latching member to be raised up;

wherein the actuating section is structured in T-shape and passed through the latching member and located below the latching member;

wherein the housing comprises an upper shield part and a lower shield part assembled with each other, the electrical connector further comprises a metallic holder binding the upper shield part and lower shield parts;

wherein the body portion of the housing is surrounded by the metallic holder, the body portion has a cross section larger than that of the mating portion.

7. The electrical connector assembly as recited in claim 6, wherein the metallic housing defines a rectangular mating port formed on a front end of the upper shield part.

8. The electrical connector assembly as recited in claim 6, wherein the electrical connector assembly further defines at least one engaging means engaging the metallic holder and the strain relief together.

9. An electrical connector assembly comprising:

a case defining a mating port forwardly communicating with an exterior; an external face defined on the case;

an mating tongue horizontally extending in the mating port;

a cable electrically connected to the mating tongue and extending rearwardly from a rear end of the case;

a latching member mounted to the exterior face in an up-and-down deflectable manner and having a front latching portion for mating with a complementary connector and a rear retaining portion for mounting to the exterior;

a pulling member associated upon said exterior face and moveable along a front-to-back direction relative to the case, said pulling member defining a front actuating section engaged with the latching member for upward lifting the latching member and a rear connecting section;

a pair of posts formed on the exterior, upper tips of which the connecting section is seated on constantly during back-and-forth movement of the pulling member;

a metallic holder circumferentially grasping the case with a tang downwardly pressing against the pulling member in a protective manner; and a strain relief assembled with the case, wherein the metallic holder is assembled to the strain relief.

* * * * *